US005456230A

United States Patent [19]

VanRens et al.

[11] Patent Number: 5,456,230

[45] Date of Patent: Oct. 10, 1995

[54] FOUR-STROKE INTERNAL COMBUSTION ENGINE WITH CONTAMINATED OIL ELIMINATION

[75] Inventors: Russell J. VanRens, Milwaukee, Wis.; William B. Rush, Antioch, Ill.

[73] Assignee: Outboard Marine Corporation, Waukegan, Ill.

[21] Appl. No.: 245,977

[22] Filed: May 19, 1994

[51] Int. Cl.[6] ..... F02B 33/06; F01M 3/00

[52] U.S. Cl. ..... 123/317; 123/196 W

[58] Field of Search ..... 123/73 AD, 196 W, 123/311, 317, 318

[56] References Cited

U.S. PATENT DOCUMENTS

| | | | |
|---|---|---|---|
| 4,381,741 | 5/1983 | Walsworth | 123/76 AD |
| 4,417,561 | 11/1983 | Yasuhara | 123/575 |
| 4,421,078 | 12/1983 | Hurner | 123/196 |
| 4,473,340 | 9/1984 | Walsworth | 123/73 AD |
| 4,599,979 | 7/1986 | Breckenfeld et al. | 123/196 W |
| 4,611,559 | 9/1986 | Sumigawa | 123/196 W |
| 4,674,456 | 6/1987 | Merritt | 123/196 |
| 4,825,825 | 5/1989 | Chino et al. | 123/196 W |
| 4,869,346 | 9/1989 | Nelson | 184/1.5 |
| 5,163,394 | 11/1992 | Koishikawa et al. | 123/196 W |

FOREIGN PATENT DOCUMENTS 5-26020 7/1991 Japan .

*Primary Examiner*—David A. Okonsky

*Attorney, Agent, or Firm*—Michael, Best & Friedrich

[57] ABSTRACT

Disclosed herein is a four-stroke internal combustion engine including a cylinder, a device for feeding fuel to the cylinder, a sealed crankcase chamber associated with the cylinder, a piston reciprocally movable in the cylinder and relative to the crankcase chamber to effect alternation of the pressure therein in response to piston reciprocation, an oil sump adapted to contain lubricating oil, a conduit system for recirculating oil from the sump to the crankcase chamber and from the crankcase chamber to the sump in response to alternation of the pressure in said crankcase chamber, an oil pump communicable with the oil sump and with the fuel feeding means, and a conduit operably connected to the oil pump and to the crankcase chamber so as to effect delivery of oil from the sump to the fuel feeding device in response to alternation of the pressure in the crankcase chamber.

14 Claims, 1 Drawing Sheet

FOUR-STROKE INTERNAL COMBUSTION ENGINE WITH CONTAMINATED OIL ELIMINATION

BACKGROUND OF THE INVENTION

Figure 1:
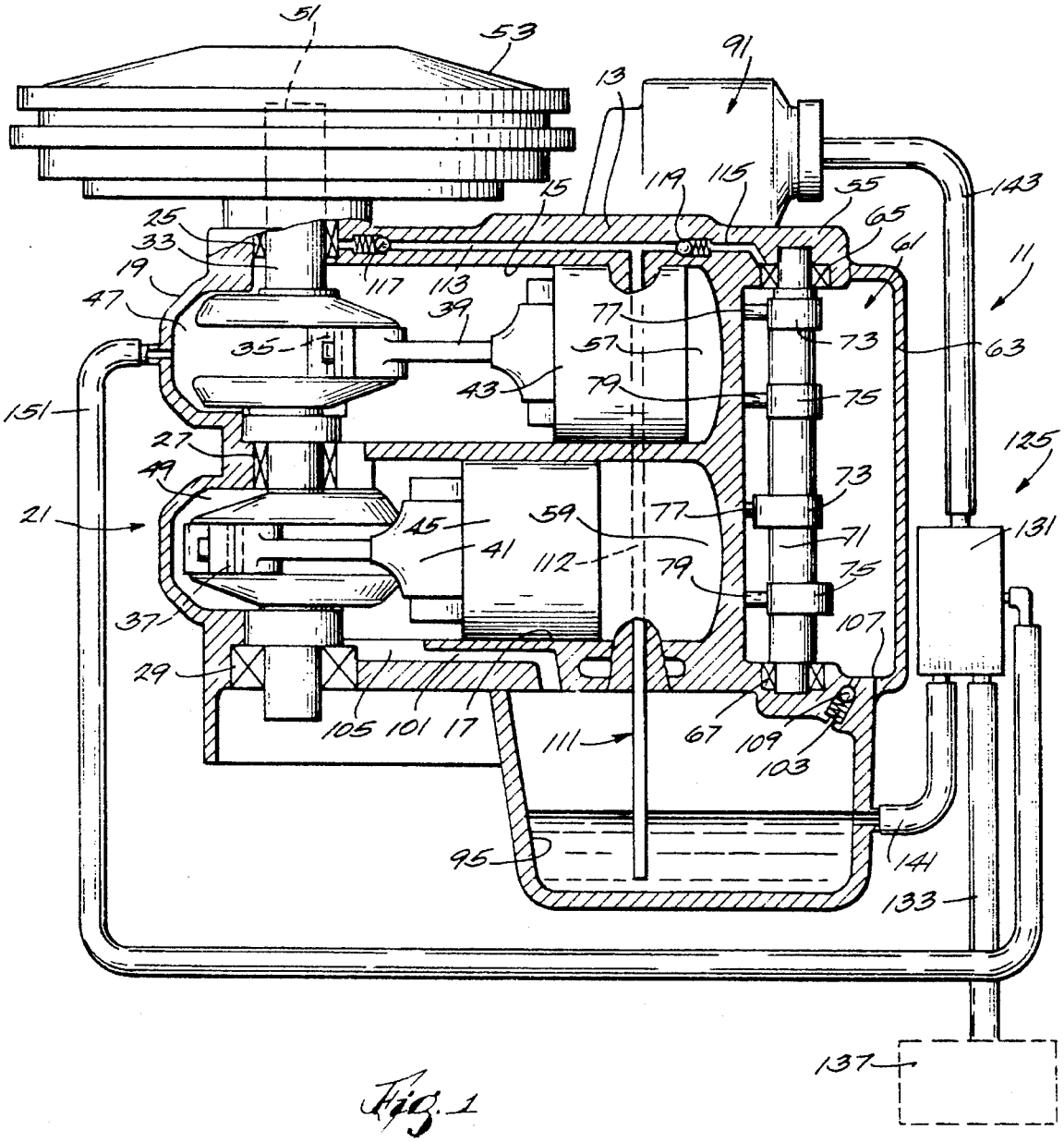

The invention relates generally to four-stroke internal combustion engines and to lubrication systems therefore. More particularly, the invention also relates to such four-stroke engines which included a crankshaft which, in the past, were supported by so called anti-friction bearings and which were supplied oil for lubrication by mechanical oil pumping arrangements.

As is well known, in many four-stroke engine installations, the lubricating oil is either pumped or splashed (or both) to the parts requiring lubrication. In these systems, engine debris and moisture can accumulate in the crankcase or oil reservoir. Consequently, in these engines, the lubricating oil is periodically drained and replaced to prevent build up or accumulation of engine debris and moisture which can be deleterious to proper lubrication and which may serve to contaminate the lubricating oil.

Attention is directed to the following U.S. Patents.

| U.S. Pat. No. | Inventor(s) | Issue Date |
|---|---|---|
| 4,417,561 | Seishi Yasuhara | November 29, 1983 |
| 4,421,078 | Erwin E. Hurner | December 20, 1983 |
| 4,674,456 | Timothy K. Merritt | June 23, 1987 |
| 4,869,346 | Donald M. Nelson | September 26, 1989 |

Attention is also directed to Japanese Application No. 3-206473 Filed Jul. 23, 1991.

SUMMARY OF THE INVENTION

The invention provides a four-stroke internal combustion engine including a cylinder, a device for feeding fuel to the cylinder, a sealed crankcase chamber associated with the cylinder, a piston reciprocally movable in the cylinder and relative to the crankcase chamber to effect alternation of the pressure therein in response to piston reciprocation, an oil sump adapted to contain lubricating oil, a conduit system for recirculating oil from the sump to the crankcase chamber and from the crankcase chamber to the sump in response to alternation of the pressure in the crankcase chamber, and an oil pump communicable with the oil sump and with the fuel feeding means for delivery of oil from the sump to the fuel feeding device.

The invention also provides a four-stroke internal combustion engine including upper and lower cylinders, a device for feeding fuel to the upper and lower cylinders, a crankcase including upper and lower sealed crankcase chambers associated respectively with the upper and lower cylinders, upper and lower pistons respectively reciprocally movable in the upper and lower cylinders and relative to the upper and lower crankcase chambers to effect alternation of the pressure therein in response to piston reciprocation, an oil sump adapted to contain lubricating oil and being in open communication with the lower crankcase chamber so as to afford drainage of oil from the lower crankcase chamber to the sump and so as to effect pressurization of the oil in the sump in accordance with pressure alternation in the lower crankcase chamber, a supply conduit extending between the sump and the upper crankcase chamber for supplying oil from the sump to the upper crankcase chamber in response to alternation of the pressure on the oil in the sump, an oil pump including an oil pumping chamber communicable with the oil sump and with the fuel feeding device and a piston reciprocally movable in the oil pumping chamber for pumping oil from the sump to the fuel feeding device, and a conduit operably connected to the oil pumping piston and to the upper crankcase chamber so as to effect reciprocation of the oil pumping piston in response to alternation of the pressure in the upper crankcase chamber.

The invention also provides a four-stroke internal combustion engine including upper and lower cylinders, a device for feeding fuel to the upper and lower cylinders, a camcase, a crankcase including upper and lower sealed crankcase chambers associated respectively with the upper and lower cylinders, upper and lower pistons respectively reciprocally movable in the upper and lower cylinders and relative to the upper and lower crankcase chambers to effect alternation of the pressure therein in response to piston reciprocation, an oil sump located below one of the crankcase and the camcase and adapted to contain lubricating oil, a conduit providing open communication between the lower crankcase chamber and the sump so as to afford drainage of oil from the lower crankcase chamber to the sump and so as to effect pressurization of the oil in the sump in accordance with pressure alternation in the lower crankcase chamber, a duct communicating between the sump and the upper crankcase chamber and the camcase and including a check valve permitting flow from the sump to the upper crankcase chamber and to the camcase and preventing flow from the upper crankcase chamber and the camcase to the sump and being operable to deliver oil from the sump to the upper crankcase chamber and to the camcase in response to alternation of the pressure on the oil in the sump, another conduit communicating between the camcase and the sump and including a check valve permitting flow from the camcase to the sump and preventing flow from the sump to the camcase, an oil pump communicable with the oil sump and with the fuel feeding device, and another duct operably connected between the oil pump and the upper crankcase chamber so as to effect delivery of oil from the sump to the fuel feeding device in response to alternation of the pressure in the upper crankcase chamber.

Other features and advantages of the invention will become apparent to those skilled in the art upon review of the following detailed description, claims and drawings.

THE DRAWINGS

FIG. 1 is a partially schematic view, partially in section, of a four-stroke internal combustion engine embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a four-stroke internal combustion engine 11 which is particularly adapted to be employed in an outboard motor (not shown).

The engine 11 includes a cylinder block 13 defining horizontally extending upper and lower cylinders 15 and 17 and a crankcase cover 19 which is fixed to the cylinder block 13 and which completes a crankcase 21. Mounted in the crankcase 21 by suitable upper, lower, and intermediate needle bearing assemblies 25, 27, and 29 is a suitable, vertically oriented crankshaft 33 including upper and lower oppositely located crank pins 35 and 37 located at an angular spacing of 180° to each other. The crank pins 35 and 37 are rotatably connected to respective upper and lower connecting rods 39 and 41 which, in turn, are pivotally connected to upper and lower pistons 43 and 45 which are respectively reciprocally movable in the upper and lower horizontally extending cylinders 15 and 17 and, which, in response to such reciprocation, cause rotation of the crankshaft 33. While the disclosed engine operates on the four-stroke principle, the crankcase 21 includes upper and lower crankcase chambers 47 and 49 which are suitably closed or sealed and which, in response to respective reciprocation of the upper and lower pistons 43 and 45, are subject to alternating relatively positive and negative or high and low pressure conditions. Any suitable arrangement can be employed for sealing the crankcase chambers 47 and 49.

The crankshaft 33 includes an upper end 51 projecting beyond the crankcase 21 and having mounted thereon a suitable flywheel 53.

The engine 11 also includes a cylinder head 55 which is suitably fixed to the cylinder block 13, which defines upper and lower combustion chamber recesses 57 and 59 in respective horizontal alignment with the upper and lower cylinders 15 and 17 and which, in part, defines a camcase 61 which is completed by a camcase cover 63 which is suitably fixed to the cylinder head 55.

Suitably mounted upper and lower bearings 65 and 67, supported by the cylinder head 55, serve to rotatably support a vertically extending camshaft 71 within the camcase 61. The camshaft 71 includes, for each cylinder, an inlet valve cam 73 and an exhaust outlet valve cam 75. The cams 73 and 75 cooperate with respective rocker arms 77 and 79 which are pivotally arranged on a vertically extending rocker arm supporting shaft (not shown) supported by the cylinder head 55. The cams 71 and 73 are operative, in response to camshaft rotation, to effect lifting, i.e., opening, of associated inlet valves (not shown) and exhaust valves (not shown). The inlet valves and exhaust valves extend in respective inlet and exhaust passage (not shown) formed in the cylinder head 55. Any suitable arrangement (not shown) can be employed to rotate the camshaft 71 at one half of the rate of rotation of the crankshaft 33. The exhaust passages are connected through a common exhaust manifold (not shown) with any suitable arrangement for discharging the exhaust gas under water as is well known in the outboard motor art.

The inlet passages are connected to a common inlet manifold (not shown) which is suitably fixed to the cylinder head 55 and which provides a common passage (not shown) leading to a fuel feeding device 91 which can be in the form of a carburetor which includes a throttle valve (not shown) controlling flow through an induction passage (not shown) and a float bowl (not shown) providing a local supply of fuel for feeding to the engine cylinders 15 and 17.

The engine 11 also includes an oil sump or reservoir 95 which can be part of an outboard motor drive shaft housing (not shown) and which is suitably located below one or both of the cylinder block 13 and cylinder head 55, i.e., below one or both of the crankcase 21 and the camcase 61.

The engine 11 also includes a conduit system for recirculating oil from the sump 95 to the upper and lower crankcase chambers 47 and 49 and from the crankcase chambers to the sump 95 (and to and from the camcase 61) in response to alternation of the pressure in the crankcase chambers. While other constructions can be employed, in the disclosed construction, suitable conduits or ducts 101 and 103 respectively communicate between the sump 95 and respective low spots 105 and 107 in the crankcase 21 and camcase 61 for returning oil from the crankcase low spot 105 and from the camcase low spot 107 to the sump 95. The conduit 101 is open between the lower crankcase chamber 49 and the sump 95 and, thus, the oil in the sump 95 is pressurized in accordance with pressurization of the lower crankcase chamber 49. The conduit 103 between the camcase low spot 107 and the sump 95 includes a one way valve 109 arranged so as to permit drainage from the camcase 61 into the sump 95 when the pressure in the sump 95 is negative or low and so as to prevent flow from the sump 95 to the camcase 61 when the pressure in the sump 95 is positive or high.

The conduit system also includes means for conveying or delivering lubricating oil from the sump 95 to the upper crankshaft bearing assembly 25 and to the upper camshaft bearing 65, thereby to provide lubricating oil to the crankcase 21 and the camcase 61. While various arrangements can be employed, in the disclosed construction, a lubricating oil supply conduit or duct 111 extends from adjacent the bottom of the sump 95 through one or both of the cylinder block 13 and the cylinder head 55 and includes a common portion, 112 a crankcase branch 113, and a camcase branch 115 extending respectively from the common portion 112 to the upper crankshaft bearing assembly 25 and the upper camshaft bearing 65. The crankcase branch 113 and the camcase branch 115 respectively include one way valves 117 and 119 permitting flow from the sump 95 to the crankcase 21 and the camcase 61 but preventing backflow. If desired a single one way valve could be employed in the common portion 112 of the supply conduit 111. Accordingly, when the lower crankcase chamber 49 is pressurized positively, the pressure acting on the surface of the lubricating oil in the sump 95 causes lubricating oil to flow through the supply conduit 111 and past the check valves 117 and 119 to the upper crankcase bearing assembly 25 and to the upper camshaft bearing 65 and from these bearings into the crankcase 21 and the camcase 61. More specifically, after draining from the upper crankcase bearing assembly 25, the lubricating oil flows downwardly by gravity, lubricating the connecting rod 39 and piston 43 located in the upper crankcase chamber 47, then flows through the intermediate crankshaft bearing assembly 29, then lubricates the connecting rod 41 and piston 45 located in the lower crankcase chamber 49, and finally flows to the lower crankshaft bearing assembly 27 and the crankcase low spot 105. From the crankcase low spot 105 the lubricating oil drains through the conduit 101 back to the sump 95.

In like manner, oil supplied to the upper camshaft bearing 65 flows downwardly by gravity into the camcase 61 and thereby lubricates the inlet and exhaust cams 73 and 75, the rocker arms 77 and 79, and the inlet and exhaust valves. The lubricating oil then flows to the camcase low spot 107 and from the camcase low spot through the conduit 103 back to the sump 95.

There is thus provided a recirculating lubricating system which recirculates lubricating oil between the sump 95 and each of the crankcase 21 and the camcase 61. Such recirculation can result in accumulation, in the sump 95, of debris from the engine 11 and moisture which, if not purged from the sump, could act to degrade the lubricating oil.

The engine 11 also includes a device or oil pump 125 for pumping lubricating oil from the sump 95 to the carburetor 91 so as to prevent build up in the sump 95 of such debris and moisture and thereby to prevent degrading of the lubricating oil. The lubricating oil supplied from the sump 95 to the carburetor 91 is burnt in the cylinders 15 and 17 and is discharged as exhaust gas into the atmosphere, carrying with it the debris and the moisture.

While various oil pumping devices can be employed, in the disclosed construction, the oil pumping device 125 comprises a combination fuel and oil pumping assembly 131, such as shown in U.S. Pat. No. 4,473,340, incorporated herein by reference. In this regard, the fuel and oil pumping assembly 131 includes respective fuel pumping and oil pumping chambers (not shown) which respectively communicate through a fuel conduit 133 with a fuel tank 137 and through an oil conduit 141 with the oil sump 95. Located respectively in the fuel pumping chamber and in the oil pumping chamber are movable fuel pumping and oil pumping walls or pistons (not shown) which are connected for common reciprocating movement in the respective fuel pumping and oil pumping chambers so as to supply fuel and oil to the fuel feeding device 91 through separate conduits (not shown) or through a common conduit 143. The combined oil pumping and fuel pumping assembly is preferably arranged to meter small quantities of oil relative to the fuel flow. In a preferred embodiment the combined assembly is arranged to meter oil at a constant ratio of fuel to oil in the neighborhood of 500 to 1.

Extending between the upper crankcase chamber 47 and the fuel and oil pumping assembly 131 is a duct 151 for communicating the alternating pressure in the upper crankcase chamber 47 to the pumping assembly 131 in such manner as to effect reciprocation of the fuel and oil pumping pistons in response to alternation of the pressure in the upper crankcase chamber 47.

As a consequence of the foregoing arrangement, one or both of the crankshaft 33 and the camshaft 71 can be supported With less expensive needle bearing assemblies and lubricated in a recirculating lubricating oil system while, at the same time, any debris and moisture which might otherwise accumulate or concentrate in the lubricating oil is purged from the engine 11 by continuously supplying small amounts of lubricating oil, including such debris and moisture, from the sump 95 to the carburetor 91 for burning in the engine 11 and discharge from the engine 11 in an ecologically sound manner.

Various of the features of the invention are set forth in the following claims.

We claim:

1. A four-stroke internal combustion engine including a cylinder, a device for feeding fuel to said cylinder, a sealed crankcase chamber associated with said cylinder, a piston reciprocally movable in said cylinder and relative to said crankcase chamber to effect alternation of the pressure therein in response to piston reciprocation, an oil sump adapted to contain lubricating oil, a conduit system for recirculating oil from said sump to said crankcase chamber and from said crankcase chamber to said sump in response to alternation of the pressure in said crankcase chamber, and an oil pump communicable with said oil sump and with said fuel feeding means for delivery of oil from said sump to said fuel feeding device.

2. An engine in accordance with claim 1 wherein said fuel feeding device comprises a carburetor.

3. An engine in accordance with claim 1 wherein said sump has a bottom, and wherein said conduit system includes a supply conduit extending from adjacent said bottom of said sump to said crankcase chamber and includes therein a check valve permitting flow from said sump to said crankcase chamber and preventing flow from said crankcase chamber to said sump, and a second conduit extending between said crankcase and said sump for draining oil from said crankcase chamber to said sump and for applying the pressure in said crankcase chamber to the surface of the oil in said sump.

4. An engine in accordance with claim 3 and further including a crankshaft extending in said crankcase chamber and supported by an upper needle bearing assembly, and wherein said supply conduit extends to said upper needle bearing assembly.

5. An engine in accordance with claim 1 wherein said oil sump is located below said crankcase chamber.

6. A four-stroke internal combustion engine including upper and lower cylinders, a device for feeding fuel to said upper and lower cylinders, a crankcase including upper and lower sealed crankcase chambers associated respectively with said upper and lower cylinders, upper and lower pistons respectively reciprocally movable in said upper and lower cylinders and relative to said upper and lower crankcase chambers to effect alternation of the pressure therein in response to piston reciprocation, an oil sump adapted to contain lubricating oil and being in open communication with said lower crankcase chamber so as to afford drainage of oil from said lower crankcase chamber to said sump and so as to effect pressurization of the oil in said sump in accordance with pressure alternation in said lower crankcase chamber, a supply conduit extending between said sump and said upper crankcase chamber for supplying oil from said sump to said upper crankcase chamber in response to alternation of the pressure on the oil in said sump, an oil pump including an oil pumping chamber communicable with said oil sump and with said fuel feeding device and a piston reciprocally movable in said oil pumping chamber for pumping oil from said sump to said fuel feeding device, and a conduit operably connected to said oil pumping piston and to said upper crankcase chamber so as to effect reciprocation of said oil pumping piston in response to alternation of the pressure in said upper crankcase chamber.

7. An engine in accordance with claim 6 wherein said fuel feeding device comprises a carburetor.

8. An engine in accordance with claim 6 and further including a crankshaft extending in said crankcase and supported by upper and lower needle bearing assemblies, and wherein said supply conduit extends to said upper needle bearing assembly.

9. An engine in accordance with claim 6 wherein said sump is located below said crankcase.

10. A four-stroke internal combustion engine including upper and lower cylinders, a device for feeding fuel to said upper and lower cylinders, a cam case, a crankcase including upper and lower sealed crankcase chambers associated respectively with said upper and lower cylinders, upper and lower pistons respectively reciprocally movable in said upper and lower cylinders and relative to said upper and lower crankcase chambers to effect alternation of the pressure therein in response to piston reciprocation, an oil sump located below one of said crankcase and said camcase and adapted to contain lubricating oil, a conduit providing open communication between said lower crankcase chamber and said sump so as to afford drainage of oil from said lower crankcase chamber to said sump and so as to effect pressurization of the oil in said sump in accordance with pressure alternation in said lower crankcase chamber, a duct communicating between said sump and each of said upper crankcase chamber and said camcase and including a check valve permitting flow from said sump to said upper crankcase chamber and said camcase and preventing flow from said upper crankcase chamber and said camcase to said sump and being operable to deliver oil from said sump to said upper crankcase chamber and said camcase in response to alternation of the pressure on the oil in said sump, another conduit communicating between said camcase and said sump and including a check valve permitting flow from said camcase to said sump and preventing flow from said sump to said camcase, an oil pump communicable with said oil sump and with said fuel feeding device, and another duct operably connected between said oil pump and said upper crankcase chamber so as to effect delivery of oil from said sump to said fuel feeding device in response to alternation of the pressure in said upper crankcase chamber.

11. An engine in accordance with claim 10 wherein said fuel feeding device comprises a carburetor.

12. An engine in accordance with claim 10 and further including a crankshaft extending in said crankcase and supported by an upper, lower, and intermediate needle bearing assemblies, and wherein said duct extends to said upper needle bearing assembly.

13. An engine in accordance with claim 10 and further including a camshaft extending in said camcase and supported by upper and lower bearings and wherein said duct extends to said upper camshaft bearing.

14. An engine in accordance with claim 10 wherein said upper and lower cylinders are oppositely acting.

* * * * *